US005826871A

United States Patent [19]

Li

[11] Patent Number: 5,826,871

[45] Date of Patent: Oct. 27, 1998

[54] TWO-LAYER INTELLECTUAL CUBE

[76] Inventor: Chen Sen Li, No. 25, Lane 169, Cheng-Ho Rd., Been-Shang Village, San-Min Area, Kaohsiung City, Taiwan

[21] Appl. No.: 997,372

[22] Filed: Dec. 23, 1997

[51] Int. Cl.[6] ..... A63F 9/08

[52] U.S. Cl. ..... 273/153 S

[58] Field of Search ..... 273/153 S, 153 R, 273/157 R

[56] References Cited

U.S. PATENT DOCUMENTS

| | | | |
|---|---|---|---|
| 4,405,131 | 9/1983 | Horvath | 273/153 S |
| 4,540,177 | 9/1985 | Horvath | 273/153 S |
| 5,271,688 | 12/1993 | Chang | 273/153 S |

FOREIGN PATENT DOCUMENTS

| | | | |
|---|---|---|---|
| 8105604 | 7/1983 | Netherlands | 273/153 S |
| 2092454 | 8/1982 | United Kingdom | 273/153 S |
| 2113104 | 8/1983 | United Kingdom | 273/153 S |

*Primary Examiner*—Steven B. Wong
*Attorney, Agent, or Firm*—Bacon & Thomas

[57] ABSTRACT

A two-layer intellectual cube composed of eight movable smaller blocks, each side thereof is divided horizontally and vertically into four areas with different paterns or colors; these smaller blocks can be rotated to change their orientations, so that every side of the intellectual cube can be varied in combination, and this can arouse brains of human to get an intellectual enhancing effect. The feature of such structure is that, the interior portion of a smaller movable block is taken as a reference smaller block which has a triangular axle seat extending from the inner end thereof, an arciform raised rail is provided on the wider area of every one of three surfaces of the triangular axle seat which is provided on the corner formed by three surfaces thereof with three mandrels pivotally provided each with a rotatable block, a receiving space is formed between every rotatable block and its corresponding raised rail to receive many outer and inner slidable blocks, so that these slidable blocks can be displaced revolvingly about a corresponding mandrel along the track of the corresponding raised rail, in which, each outer slidable block is provided on an outer end thereof with a seat block, and when an outer housing block is provided on each of the smaller movable blocks, the two-layer intellectual square cube is completed. In this way, the present invention can reduce complexity and especially suits little learning children in playing.

12 Claims, 13 Drawing Sheets

(A)

TWO-LAYER INTELLECTUAL CUBE

BACKGROUND OF THE INVENTION

1. Field of the Invention

The present invention is related to a two-layer intellectual cube, and especially to a two-layer intellectual square cube composed of eight movable smaller blocks, each side of the intellectual cube is divided horizontally and vertically into four areas with different paterns or colors; these smaller blocks can be rotated to change their orientations, so that every side of the intellectual cube can be varied in combination, and this can arouse brains of human to get an intellectual enhancing effet, and especially is useful for children.

2. Description of the Prior Art

As shown in FIG. 1, a conventional intellectual cube (or so called magic cube) is a square cube A having six sides each composed of nine (3×3) movable smaller surfaces and is in three layers, normally the six sides of the square cube A are applied each with a different color respectively, i.e., the nine small movable areas in each side formed by the nine smaller blocks are in one color, when any layer is rotated to change their positions, the small movable areas in the periphery thereof are moved to other sides of different colors, therefore this latter sides have miscellaneous colors; when in playing, the way of playing is to mix up the colors of the six sides of the square cube A, then to rotate all the layers to move the movable areas having same singular colors to get in their proper sides, until all the six sides of the square cube A recover their own singular colors.

The aforesaid conventional three-layer intellectual cube has the worst disadvantage of excessive complexity, it is more suitable for youths or adults, and if any one of them is less impatient, he may give up after having played for one or two hours without any good result, such cube is even more inaccessible for a learner or a child.

In view of the disadvantage resided in the conventional three-layer intellectual cube, the inventor of the present invention thought of simplifying of it, the straight notion is simplification of the three-layer intellectual cube into a two layer intellectual cube, i.e., each side of the intellectual cube is divided horizontally and vertically only into four areas totally. However, it is found very difficult to put it into effect after study, and this is why there is never a two-layer intellectual cube appeared in the markets.

The structure of the three-layer intellectual cube is now described firstly, it is comprised, as is shown in FIG. 2, of a cross shaped central axle block 1, six rotatable blocks 2, twelve edge-blocks 3 and eight corner-blocks 4, wherein:

The cross shaped central axle block 1 is formed by intercrossing of three axles perpendicular to one another, so that the cross shaped central axle block 1 is formed to have six terminal pivotal connecting ends 11 enxtending in different orientations.

The rotatable blocks 2 are pivotally connected respectively to each of the pivotal connecting ends 11, so that the rotatable blocks 2 are located at the centers of the six surfaces of the six sides of the square cube A respectively and form therewith "T" shapes, these surfaces face outwardly and are rotatable.

The twelve edge-blocks 3 are positioned each between every two neighbouring rotatable blocks 2, taking the rotatable block 2 facing to the front side as a reference block, there are four edge blocks 3 allocated in the front surface and respectively at the top, bottom, left and right ends thereof; the rear rotatable block 2 is also accompanied by four edge blocks 3 allocated respectively at the top, bottom, left and right ends thereof; plus other four edge blocks 3 provided in the middle zone between the front and the rear rotatable blocks 2, the total amount of the edge blocks 3 is twelve.

The corner blocks 4 are located each between every two edge blocks 3 in any one of the six sides, there are totally eitht corner-blocks 4 forming the eight corners of the square cube A, they surround the rotatable blocks 2 together with the twelve edge blocks 3, when in rotation of any layer of the three layer intellectual square cube A, the rotatable block 2 on the layer rotates at its own site, while the corner blocks 4 and the edge blocks 3 in this layer circle about the rotatable block 2.

By means of the above stated three layer square cube A composed of the cross shaped central axle block 1, the rotatable blocks 2, the edge blocks 3 and the corner blocks 4, any of the six terminal pivotal connecting ends 11 on the cross shaped central axle block 1 is the center of rotation of the corresponding rotatable block 2 (the central movable surface) as well as of the multiple surrounding movable surfaces on the corresponding side, and there are totally nine (3×3) movable surfaces in each side of the six sides of the square cube A.

In taking advantage of the cross shaped central axle block 1 as a center of a two-layer square cube, the terminal pivotal connecting ends at the centers of the six sides of the square cube are each located at a position where four movable surfaces in a corresponding side are interconnected each with one of their corners, this is different from that of a three-layer square cube A wherein the terminal pivotal connecting ends at the centers of the six sides thereof are each located on a central movable surface of the nine movable surfaces on a corresponding side, hence a two layer square cube can not be put into practice with the same structure, and a novel structure is required to be designed.

SUMMARY OF THE INVENTION

In view of the above statement, the inventor of the present invention provides an intellectual two-layer square cube after study and designing of the structure therefor, it is suitable for little learning children, and can reduce complexity as that in the case of a conventional intellectual square cube.

In particular, the structure of the two-layer square cube of the present invention is composed of eight movable smaller cubes, and has six sides facing to different orientations, each side is divided vertically and horizontally into four smaller movable surfaces; by changeability of orientation by rotation of these smaller movable surfaces, every side will have various possibilities of combination of these smaller movable surfaces. The feature of such structure is that, the interior portion of a smaller movable block is taken as a reference smaller block which has a triangular axle seat extending from the inner end thereof, an arciform raised rail is provided on the wider area of every one of the three surfaces of the triangular axle seat, the triangular axle seat is provided on the corner formed by three surfaces with three mandrels, these mandrels are pivotally provided each with a rotatable block, a receiving space is formed between every rotatable block and its corresponding raised rail to receive a plurality of outer and inner slidable blocks, so that the outer and inner slidable blocks can be displaced revolvingly about a corresponding mandrel, in which, each outer slidable block is provided on the outer end thereof with a seat block, and when an outer housing block is provided on each of the smaller movable blocks, the two-layer intellectual square cube is completed. In this way, the object of reducing complexity as was mentioned above can be obtained.

The present invention will be apparent in its practical structure after reading the detailed description of the preferred embodiments thereof in reference to the accompanying drawings.

BRIEF DESCRIPTION OF THE DRAWINGS

In the drawings:

FIGS. 25–29 are perspective views showing a second assembling mode of the present invention, wherein:

FIG. 25 is a perspective view of a reference smaller block of the present invention in the second assembling mode;

FIG. 26 is a perspective view of an outer slidable block of the present invention in the second assembling mode;

FIG. 27 is a perspective view of an outer housing block of the present invention in the second assembling mode;

FIG. 28 is a perspective view of an outer housing block provided with quater-round guide rails of the present invention in the second assembling mode;

FIG. 29 is a schematical view of some outer slidable blocks and outer housing blocks of the present invention in the second assembling mode;

DETAILED DESCRIPTION OF THE PREFERRED EMBODIMENT

Figure 1:
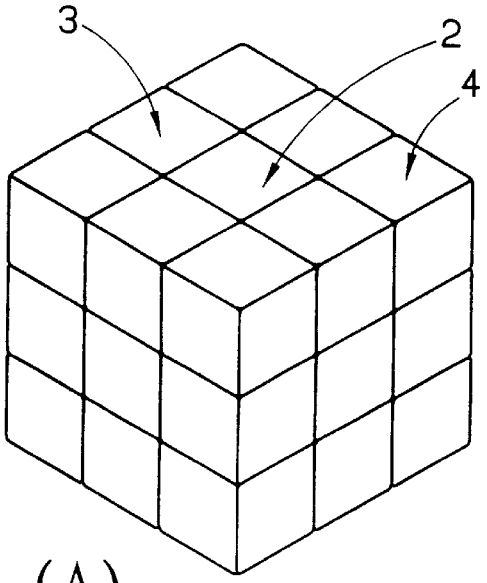
Fig. 1 PRIOR ART
FIG. 1 is a perspective view of a conventional three-layer intellectual square cube.
Figure 2:
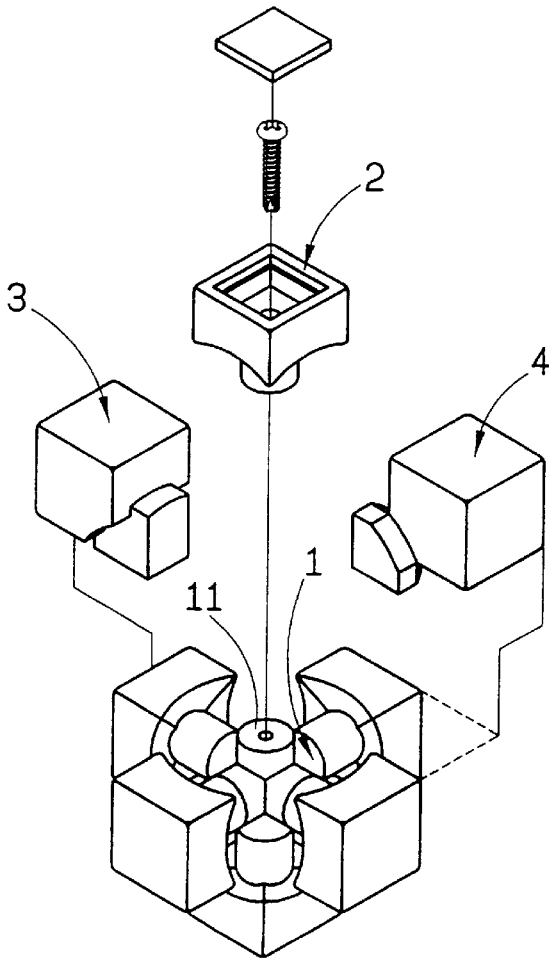
Fig. 2 PRIOR ART
FIG. 2 is a structural perspective view of the conventional three-layer intellectual square cube.
Figure 3:
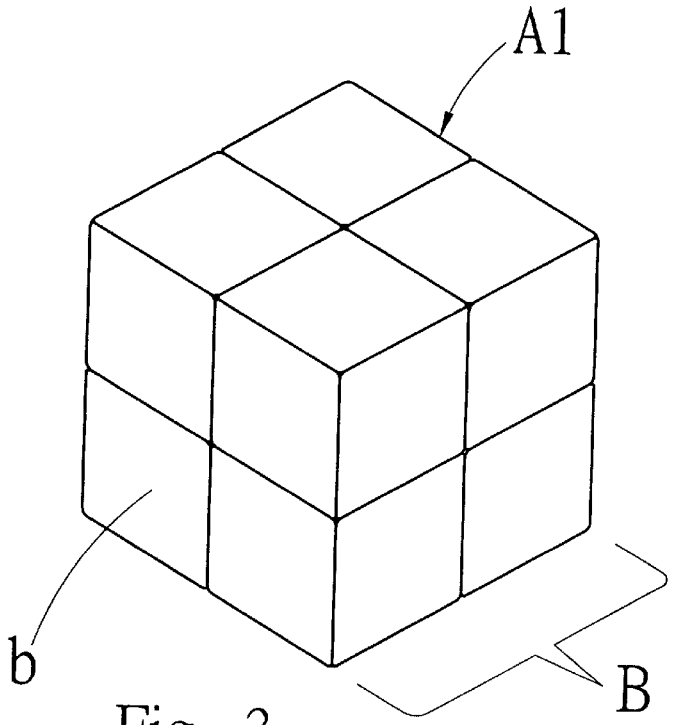
FIG. 3 is a perspective view of the first embodiment of the present invention.
Figure 4:
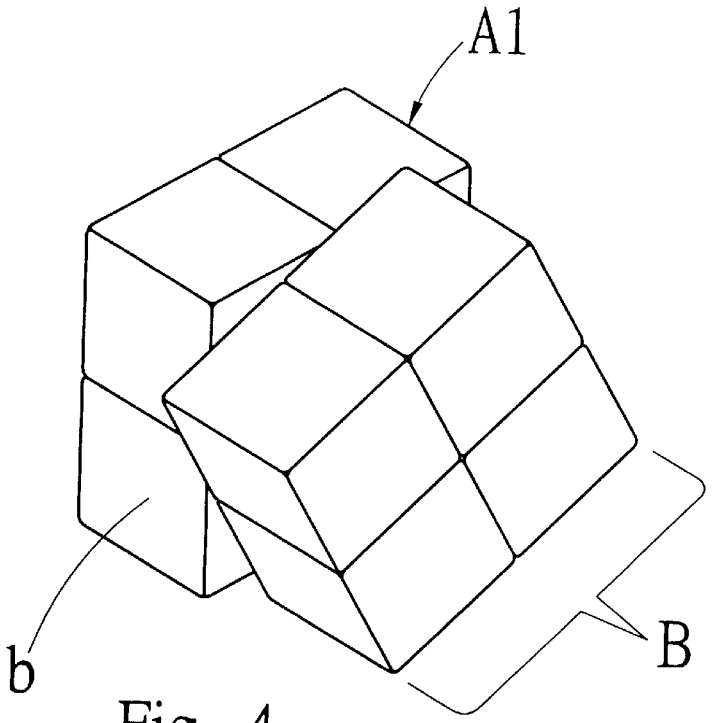
FIG. 4 is a schematic view showing use of the first embodiment of the present invention.

Referring to FIGS. 3 and 4, the structure of the first embodiment of the two-layer intellectual square cube of the present invention is comprised apparently of eight smaller movable blocks A1, and has six sides B facing to different orientations, each side B is divided vertically and horizontally into four smaller movable surfaces b; by changeability of orientation by rotation of these smaller movable blocks A1, every side B will have various possibilities of combination of these smaller movable surfaces. The feature of such structure is that, such as is shown in FIGS. 5 to 14, the interior portion of a smaller movable block is taken as a reference smaller block 10 (FIGS. 5, 6) which has a triangular axle seat 11 extending from the inner end thereof, the triangular axle seat 11 is provided on the corner formed by three surfaces thereof with three mandrels 13, these mandrels 13 are perpendicular to one another and are located toward three different orientations, taking each of the mandrels 13 as a center, an arciform raised rail 14 is provided, on the wider area of every one of the three surfaces of the triangular axle seat 11, these mandrels 13 are pivotally provided each with a rotatable block 20 (FIGS. 7, 8), a receiving space is formed between every rotatable block 20 and its corresponding raised rail 14 to separate a plurality of outer and inner slidable blocks 30, 40 (FIGS. 9 to 12), so that the outer and inner slidable blocks 30, 40 can be displaced revolvingly about a corresponding mandrel 13 along the track of the corresponding raised rail 14, in which, each outer slidable block 30 is provided on an outer end thereof with a seat block 32, and when an outer housing block 50 is provided on each of the smaller movable blocks A1 (FIGS. 13, 14), total amount of the smaller movable blocks A1 is eight, and thus the two-layer intellectual square cube is completed. In this way, the present invention can reduce complexity as that in the case of a conventional intellectual square cube, it is especially suitable for playing by little learning children.

Figure 5:
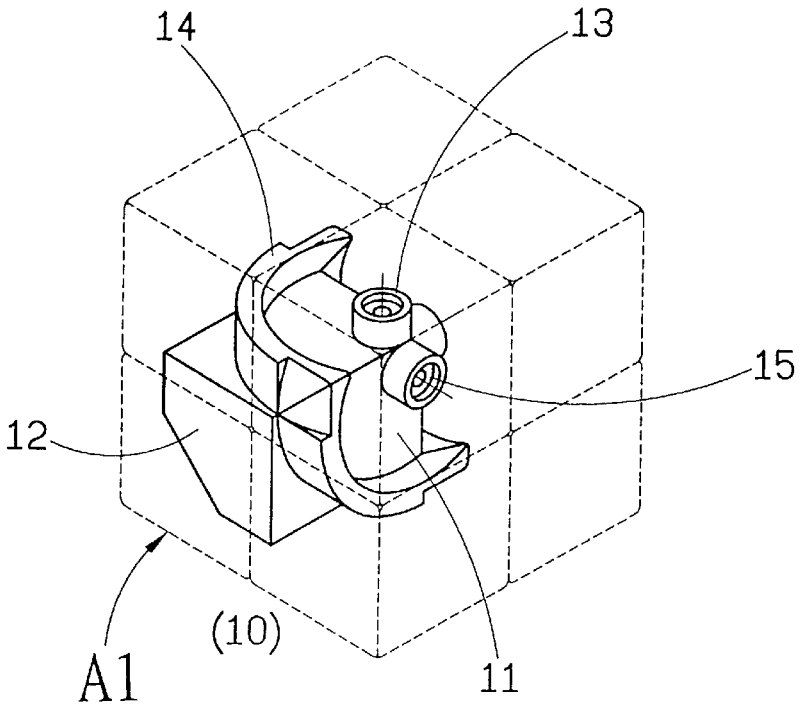
FIG. 5 is a perspective view of a reference smaller block of the first embodiment of the present invention.
Figure 6:
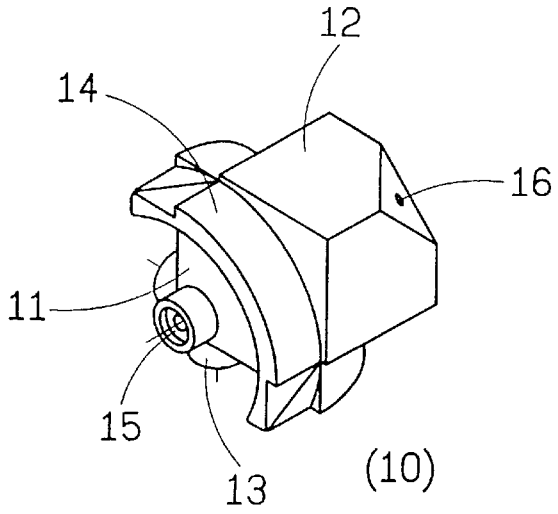
FIG. 6 is a perspective view of the reference smaller block of the first embodiment of the present invention after revolving thereof for 180 degrees to an opposite corner position.

Referring to the structure of the reference smaller block 10 shown in FIGS. 5 and 6, the reference smaller block 10 is the interior portion of one of the eight smaller movable blocks A1, the inner end thereof extends to form an above mentioned triangular axle seat 11, while the other end thereof opposite to the triangular axle seat 11 is formed a seat block 12. In which, the triangular axle seat 11 is provided on the corner formed by three surfaces thereof with three mandrels 13 which are perpendicular to one another, and are located toward three different orientations, they are located exactly at the center of the two-layer square cube, taking each of the mandrels 13 as a center, an arciform raised rail 14 is provided on the wider area of every one of the three surfaces of the triangular axle seat 11. In practising, the mandrels 13 are drilled to be provided with fixing holes 15. And a connecting hole 16 is provided at a suitable position on the seat block 12 opposite to the triangular axle seat 11.

Figure 7:
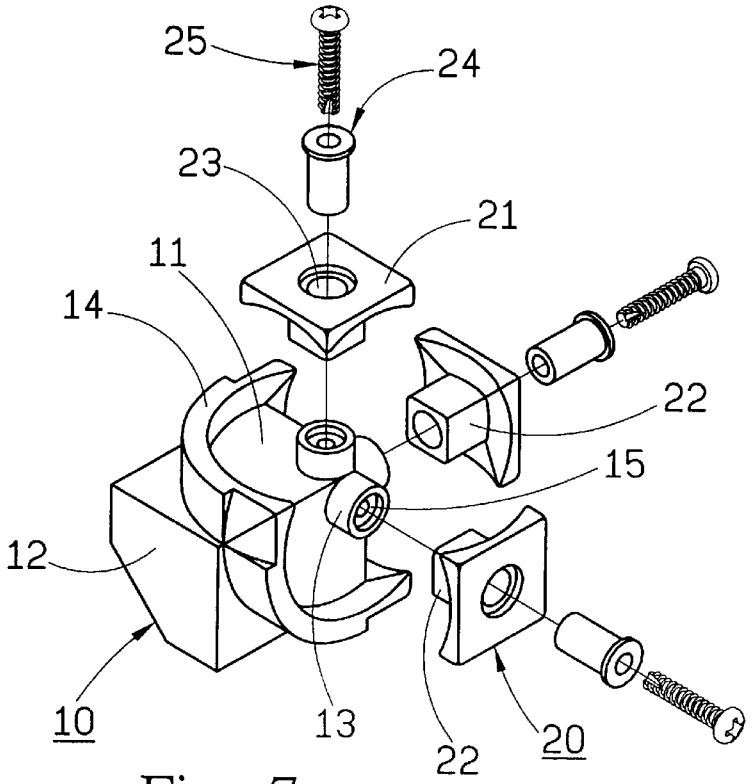
FIG. 7 is a schematic view showing combination of several rotatable blocks with a reference smaller block of the first embodiment of the present invention.
Figure 8:
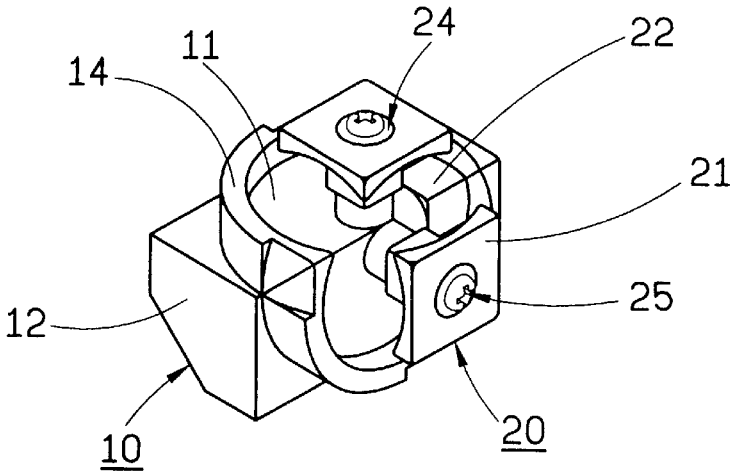
FIG. 8 is a perspective view of the assembled rotatable blocks with the reference smaller block of the first embodiment of the present invention.

Referring to FIGS. 7 and 8, in the structure of each of the rotatable blocks 20 which amount totally to three, the shape of the projection thereof is a "T", a pivot joint 22 on one end thereof is pivotally connected to each mandrel 13 of the triangular axle seat 11, while one of three limiting plates 21 is provided on the other end thereof and forms a receiving space with a corresponding arciform raised rail 14 provided on the triangular axle seat 11, the receiving space is broader inside than outside thereof, the gaps between every two limiting plates 21 are also receiving spaces of which the outer areas are broader than the inner areas. In practising, a throughhole 23 is drilled in each pivot joint 22 centrally through the limiting plate 21 of a corresponding rotatable block 20, and a sleeve 24 with a flange on the outer end thereof is inserted in each throughhole 23, align the inner end of the sleeve 24 with a fixing hole 15 on the corresponding mandrel 13, a screw 25 is threaded in the sleeve 24 and is screwed fixedly in the fixing hole 15, so that the rotatable block 20 is confined on the mandrel 13 but is rotatable about the same.

Figure 9:
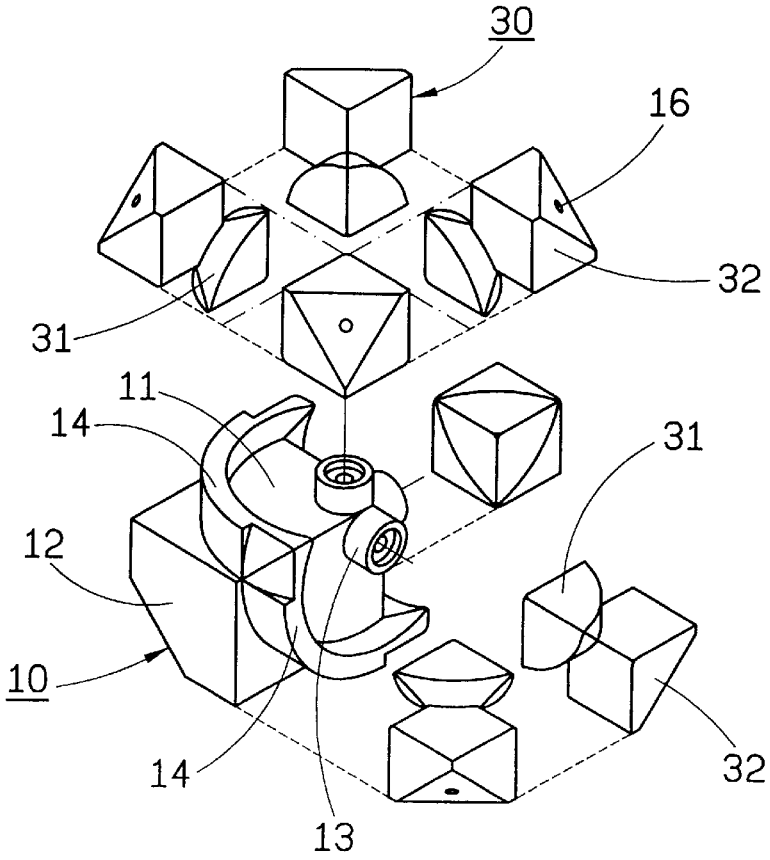
FIG. 9 is a perspective view of the reference smaller block with a plurality of outer slidable blocks of the first embodiment of the present invention.
Figure 10:
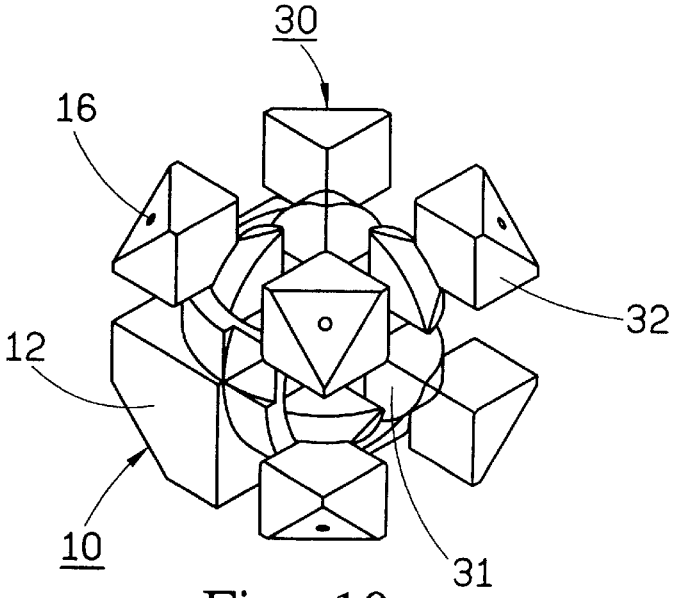
FIG. 10 is a perspective view showing the relative positions of the outer slidable blocks with the reference smaller block of the first embodiment of the present invention.

Referring to FIGS. 9 and 10, in the structure of each of the outer slidable blocks 30 which amount totally to seven, each of them has a slidable portion 31 being in the shape of a triangular block and is formed with a guide corner on the tip thereof, and a seat block 32 is extended from the slidable portion 31. In which, an end with a right angle of the slidable portion 31 is inserted inwardly in the receiving spaces formed between the aforementioned arciform raised rails 14 and their rotatable blocks 20 and between every two rotatable blocks 20 (FIG. 8), so that the slidable portion 31 is limited but slidable in the receiving space, and is located in the circumference of the mandrels 13 of the triangular axle seat 11, the seat block 32 of the outer slidable block 30 extends outwardly, and is opposite to the aforementioned seat block 12, and more, it is located at one of the eight corners of the two layer square cube (FIG. 3). Further, the seat block 32 is provided with a connecting hole 16 at a suitable position just like that on a seat block 12.

Figure 11:
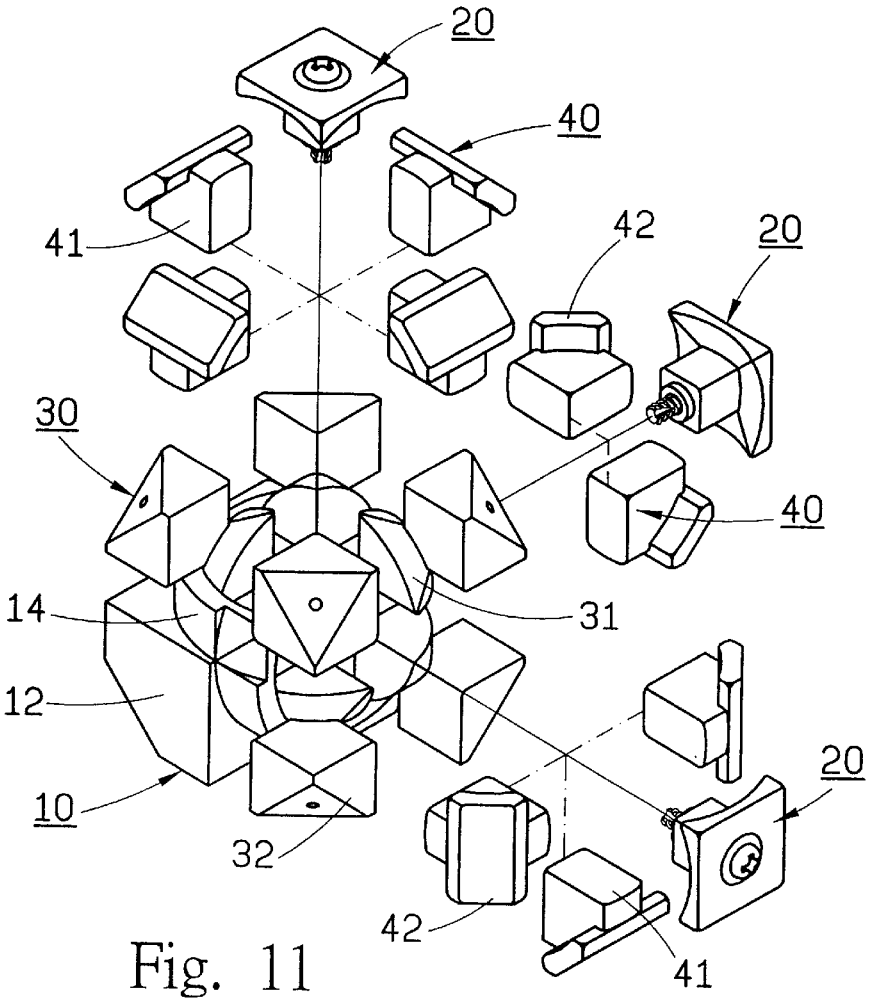
FIG. 11 is a perspective view of the reference smaller block further with a plurality of inner slidable blocks of the first embodiment of the present invention.
Figure 12:
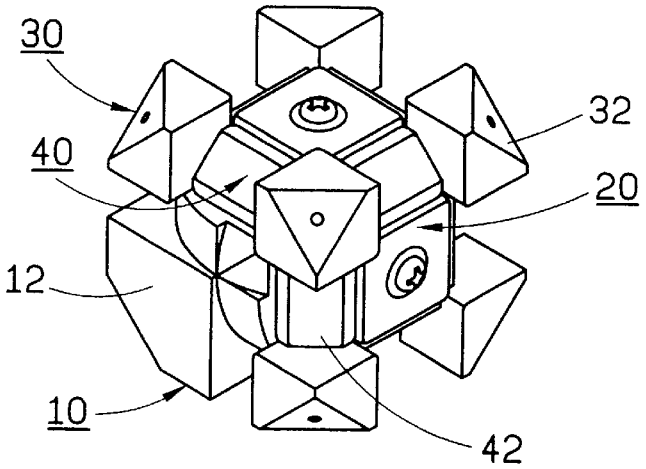
FIG. 12 is a perspective view showing the relative positions of the inner slidable blocks with the reference smaller block of the first embodiment of the present invention.

Referring to FIGS. 11 and 12, in the structure there are a plurality of inner slidable blocks 40 which are used mainly for filling in the gaps among the abovementioned slidable portions 31 and for preventing the slidable portions 31 from dropping out of the aforementioned receiving space. The structure of each of the inner slidable blocks 40 is comprised of an access plate 41 and a stop plate 42, wherein, the access plate 41 is inserted to fill in the receiving space between two neighbouring ones of the slidable portions 31, and therefore can move synchronically with the slidable portions 31; the width of the stop plate 42 is larger than that of the access plate 41, the stop plate 42 extends outwardly from the access plate 41 and is located on the periphery of the receiving space formed between the aforementioned arciform raised rails 14 and the rotatable blocks 20 and between every two rotatable blocks 20 (FIGS. 8 and 12), the two sides of the stop plate 42 exactly abut against the surfaces of the slidable portions 31 of the two outer slidable blocks 30 at both sides thereof, so that the slidable portion 31 is limited in the receiving space and is not to drop.

After completion of assembling of all the rotatable blocks 20 and the outer and inner slidable blocks 30, 40, due to the fact that the mandrels 13 of the aforementioned triangular axle seat 11 are located toward three different orientations, and as shown in FIG. 4, the ways of rotation of the two-layer square cube only amount to three, i.e., relative rotations between the left and the right layers, between the upper and the lower layers as well as the front and the rear layers, no matter which of the rotatable blocks 20 are done each about one mandrel 13, i.e., no matter in which way the outer and inner slidable blocks 30, 40 rotate, they rotate respectively about one mandrel 13 and slide along their corresponding arciform raised rails 14.

Figure 13:
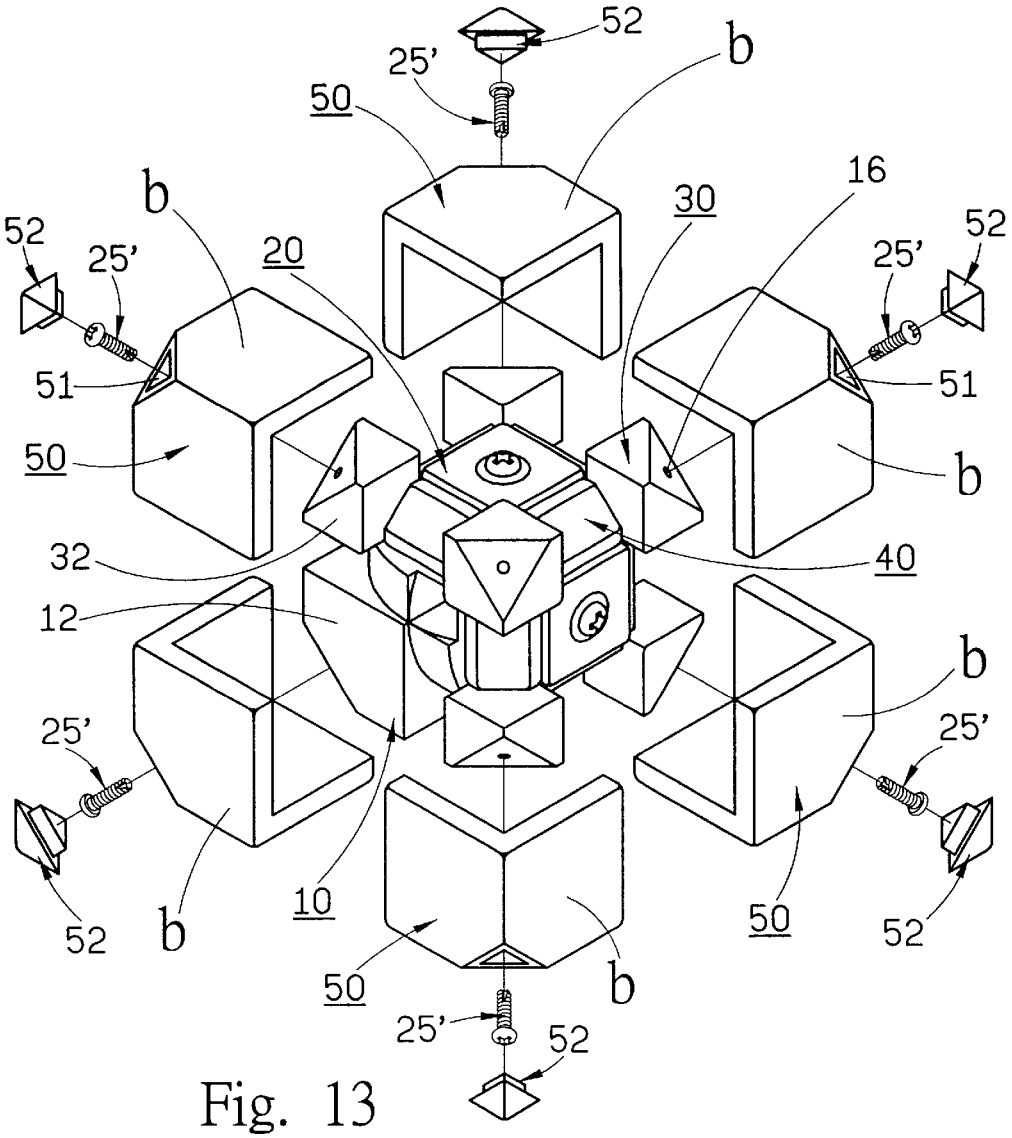
FIG. 13 is a perspective view of the reference smaller block further with a plurality of outer housing blocks of the first embodiment of the present invention.
Figure 14:
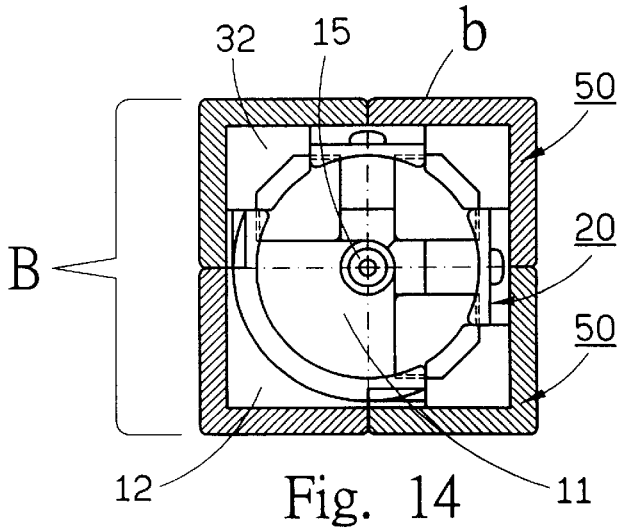
FIG. 14 is a perspective view showing the relative positions of the outer housing blocks with the reference smaller block etc. of the first embodiment of the present invention.

Referring to FIGS. 13 and 14, there they show the structure and the positions of a plurality of outer housing blocks 50. The outer housing blocks 50 fixedly and respectively cover the seat blocks 32 of the seven outer slidable blocks 30 and the seat block 12 of the reference smaller block 10, and are provided each with three smaller movable surfaces b in different orientations, so that the members mentioned above together form the two layer square cube having six sides B (FIG. 3), each side B includes four smaller movable surfaces b (the eight outer housing blocks 50 each having three smaller movable surfaces b compose the six sides B each including four of the smaller movable surfaces b), with this, the whole two-layer intellectual square cube of the present invention is formed; in other words, the eight outer housing blocks 50 are located outermostly on the eight smaller movable blocks A1 of the two-layer intellectual square cube (FIG. 3). Further, the eight outer housing blocks 50 are provided with bores 51 opposite to the connecting holes 16 provided on the seat blocks 32 and or the seat block 12 of the reference smaller block 10, when in assembling, a plurality of screws 25' can be used to extend each through a bore 51 to be fixedly connected onto one of the connecting holes 16, and finally a plurality of lids 52 are used to cover the screws 25', the two-layer intellectual square cube thus is completed.

By the above stated structure of members, when in assembling of the two-layer intellectual square cube of the present invention, as are shown in FIGS. 9 and 10, the slidable portions 31 of the seven outer slidable blocks 30 surround the mandrels 13 of triangular axle seat 11 and abut against the inner walls of the arciform raised rails 14, thus the seven seat blocks 32 of the outer slidable blocks 30 and the seat block 12 of the reference smaller block 10 are located respectively at the eight corners of the two-layer intellectual square cube. After the outer slidable blocks 30 are settled, the access plates 41 of the inner slidable blocks 40 are placed between every two slidable portions 31 (FIGS. 11 and 12), so that the two ends of each stop plate 42 abut against the surfaces of the slidable portions 31 of the two outer slidable blocks 30 at both sides thereof, then the rotatable blocks 20 are pivotally fixed onto the mandrels 13 as stated before, the limiting plates 21 of the rotatable blocks 20 prevent the slidable portions 31 of the outer slidable blocks 30 and the access plates 41 of the inner slidable blocks 40 from dropping. Finally, the eight outer housing blocks 50 are fixed on the seven seat blocks 32 and the seat block 12 of the reference smaller block 10 to complete assembling of the two-layer intellectual square cube of the present invention.

Figure 15:
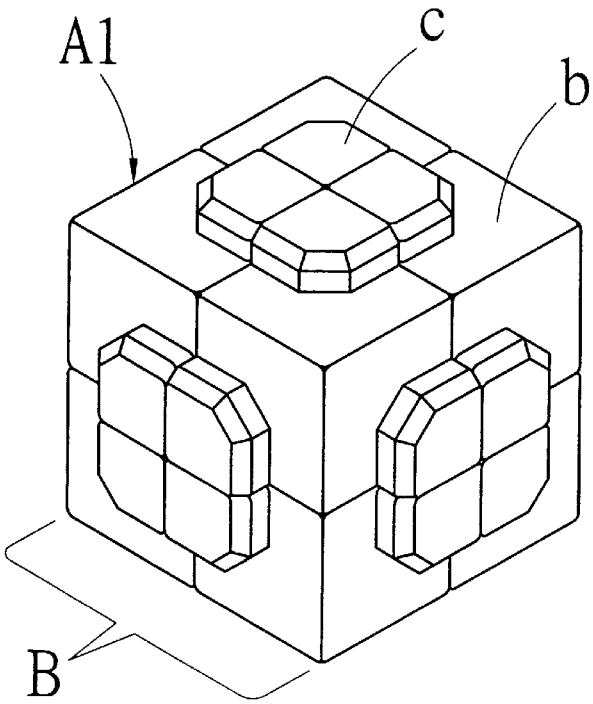
FIG. 15 is a perspective view of the second embodiment of the present invention.
Figure 16:
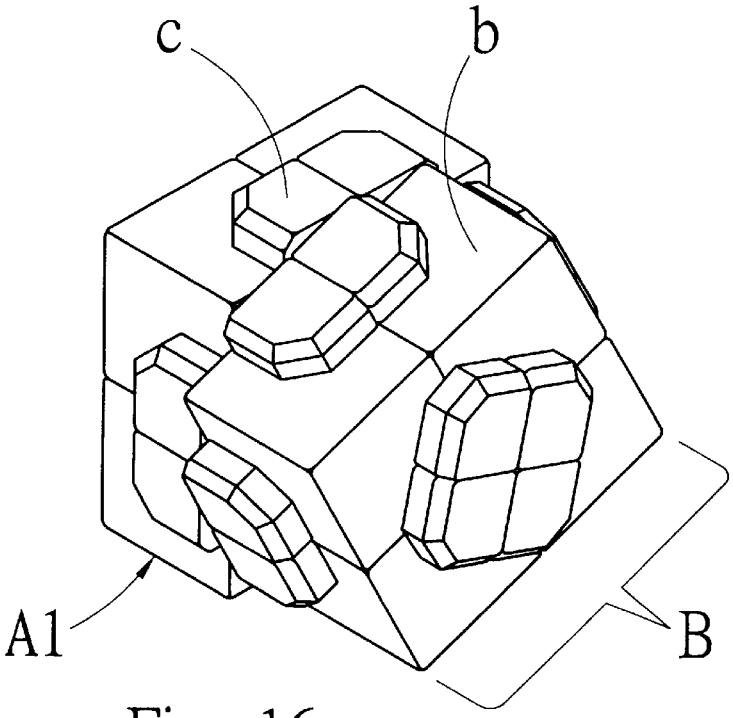
FIG. 16 is a schematic view showing use of the second embodiment of the present invention.
Figure 17:
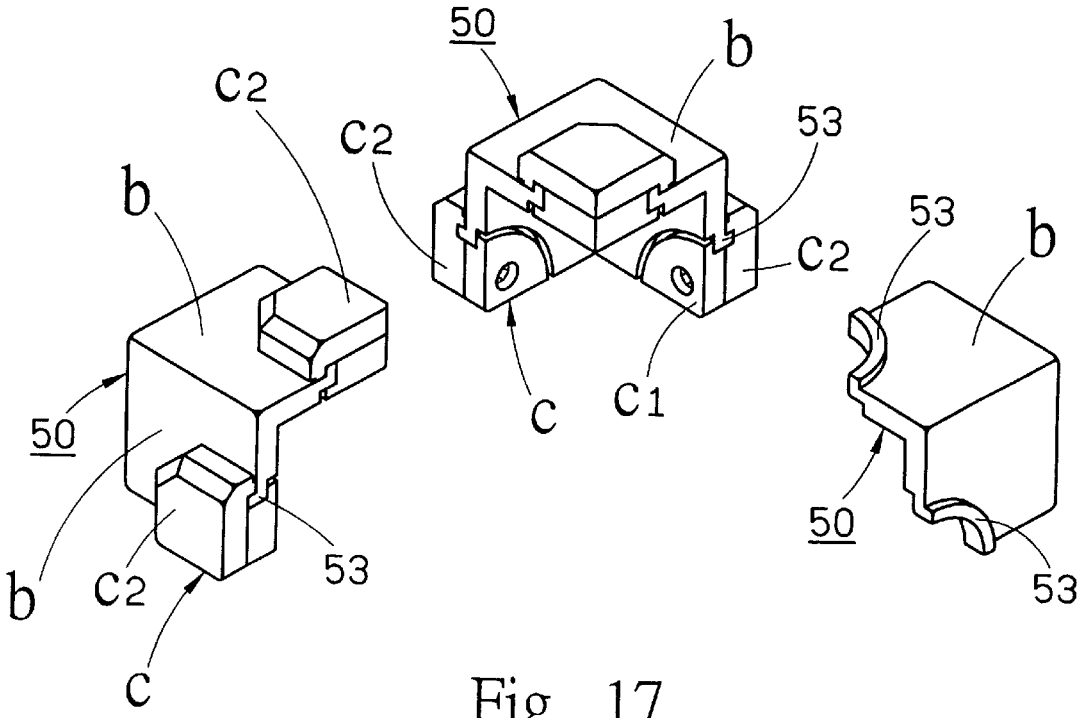
FIG. 17 is an analytic perspective view showing the outer housing blocks and rotatable plates of the second embodiment of the present invention.
Figure 18:
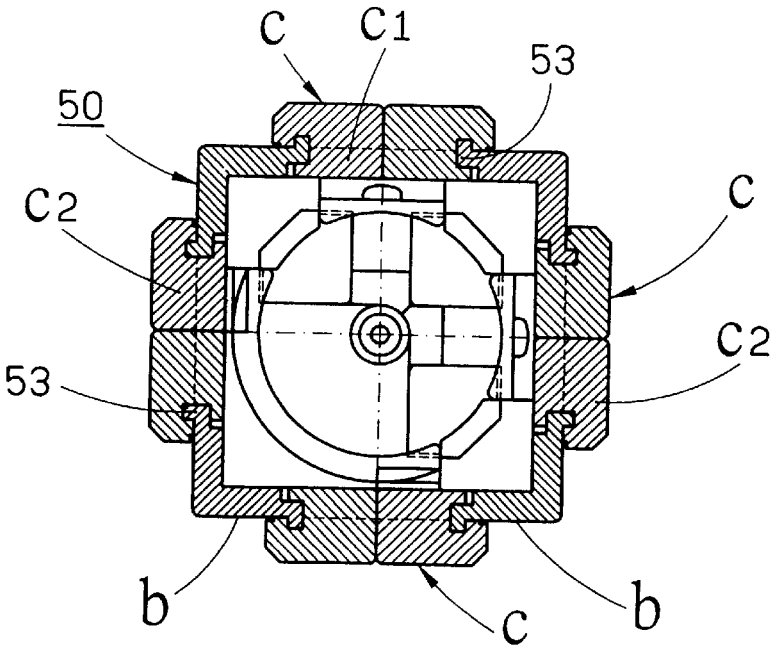
FIG. 18 is a sectional view showing the outer housing blocks and the rotatable plates of the second embodiment of the present invention after assembling.

As shown in the second embodiment depicted in FIGS. 15 and 16, apparently, the embodiment is comprised of eight smaller movable blocks A1, and has six sides B facing to different orientations, each side B is divided vertically and horizontally into four smaller movable surfaces b on which four rotatable plates c are provided at the center thereof; by changeability of orientation by rotation of these smaller movable blocks A1, every side B will have various possibilities of combination of these smaller movable surfaces b, the rotatable plates c can be rotated at the center of each side B to change the relative positions thereof with the smaller movable surfaces b, and therefore increase variety of combination of each side B.

The structure of the abovementioned second embodiment is depicted in FIGS. 5 to 18, and is comprised of the abovementioned reference smaller block 10 (FIGS. 5 and 6), rotatable blocks 20 (FIGS. 7 and 8), outer and inner slidable blocks 30, 40 (FIGS. 9 to 12) and outer housing blocks 50 (FIGS. 13 and 14), the feature thereof is as shown in FIGS. 15 to 18 and described as follows:

The three smaller movable surfaces b directing to different orientations of each outer housing block 50 are provided respectively on one end corner of each of them with a quarter-round guide rail 53, after assembling of the outer housing blocks 50, exactly at the center position of each side B composed of the four smaller movable surfaces b as stated in the preceding paragraph, the quarter-round guide rails 53 on the smaller movable surfaces b are connected to form a round, and a plurality of rotatable plates c are slidably provided each on one side of a quarter-round guide rail 53, hence when in assembling and when a side B is neatly flat, a round composed of the quarter-round guide rails 53 allows the corresponding rotatable plates c to displace by rotation and sliding at the center and to slide from one of the smaller movable surfaces b to another. When in practising, the rotatable plates c can be formed each by connection of a quarter-round bottom plate c1 and a top plate c2, hereby the second embodiment of the two-layer intellectual square cube of the present invention is completed, a learner or a little learning child familiar with the first embodiment can use progressively this intellectual square cube with more complexity.

Figure 19:
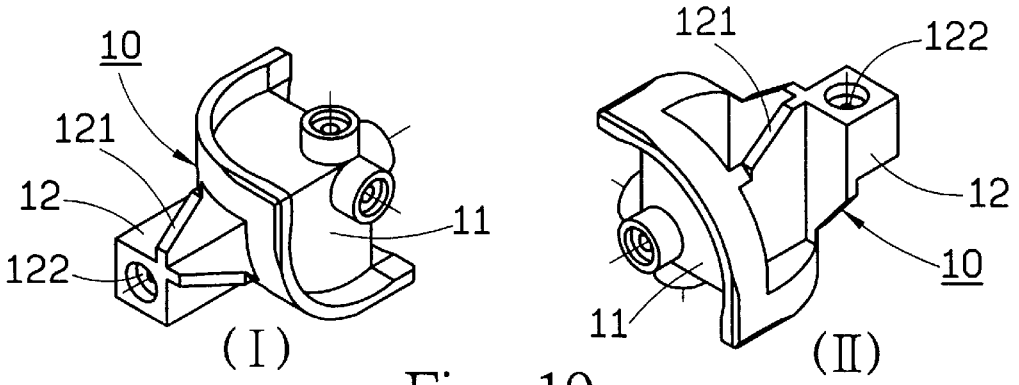
FIG. 19 is a perspective view of an reference smaller block of the present invention in assembling.

Beside the structures stated above, the present invention can be produced and assembled in accordance with the embodiment shown in FIGS. 19 to 30:

Please refer to FIG. 19 which is a front and a rear perspective view respectively of a reference smaller block 10 of the present invention in assembling. The triangular axle seat 11 shown in the drawing is the same as before, and in which the seat block 12 of the reference smaller block 10 is reduced in size and is in the shape of a small square cube, and is provided at suitable positions thereon with reinforcement ribs 121, and is provided on the end thereof with a countersunk screw hole 122; wherein, size of the seat block 12 of the reference smaller block 10 is reduced to reduce weight, and the reinforcement ribs 121 are provided thereon in order to strengthen it, the countersunk screw hole 122 is provided on the end thereof for use in assembling.

Figure 20:
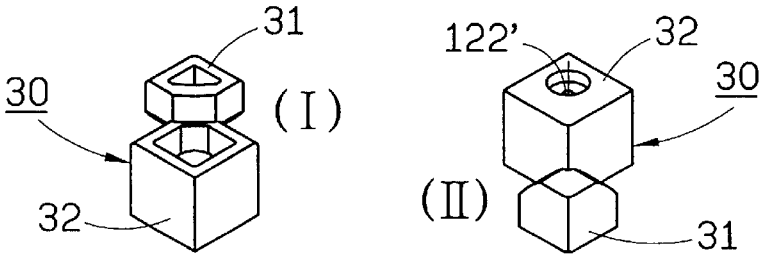
FIG. 20 is a perspective view of an outer slidable block of the present invention in assembling.

Please refer to FIG. 20 which shows a front and a rear perspective view respectively of an outer slidable block 30 of the present invention in assembling, wherein, the basic structure of the outer slidable block 30 is kept unchanged, but the bottom of the slidable portion 31 and the seat block 32 is excavated, the seat block 32 is also provided with a countersunk screw hole 122' on the upper end thereof; wherein, the excavated slidable portion 31 and the seat block 32 are also for reducing weight, and the countersunk screw hole 122' provided on the end thereof is for use in assembling too.

Figure 21:
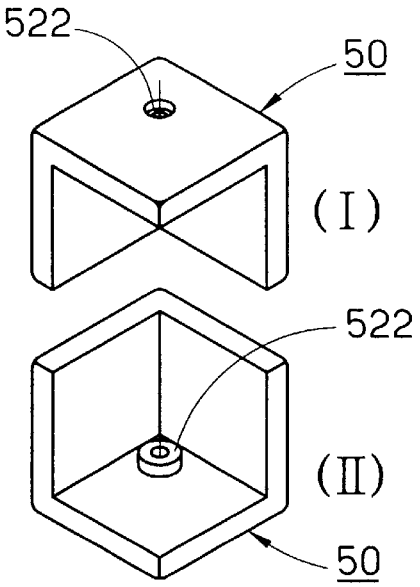
FIG. 21 is a perspective view of an outer housing block of the present invention in assembling.

Please refer to FIG. 21 which shows a front and a rear perspective view respectively of an outer housing block 50 of the present invention in assembling, wherein, the structure of the outer housing block 50 is kept unchanged, but the inner side of one end plate thereof is provided with a stub 522 corresponding in position to an abovementioned countersunk screw hole 122 or 122'.

Figure 22:
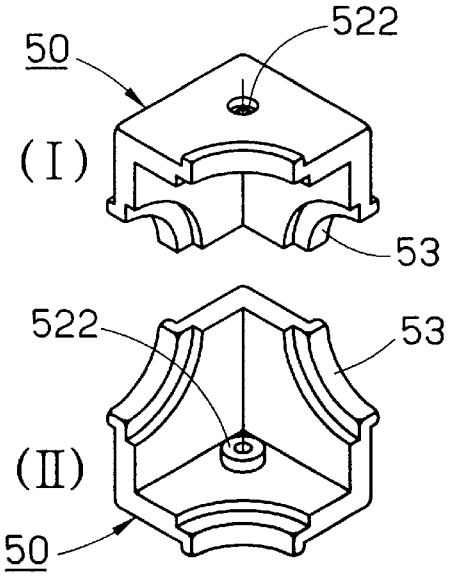
FIG. 22 is a perspective view of an outer housing block provided with quter-round guide rails of the present invention in assembling.

Referring to FIG. 22 which shows a front and a rear perspective view respectively of an outer housing block 50 of the present invention provided with the abovementioned quater-round guide rails 53, wherein, the structure of the outer housing blocks 50 is kept unchanged, but the inner side of one end plate thereof is provided with a stub 522 corresponding in position to an abovementioned countersunk screw hole 122 or 122'.

Figure 23:
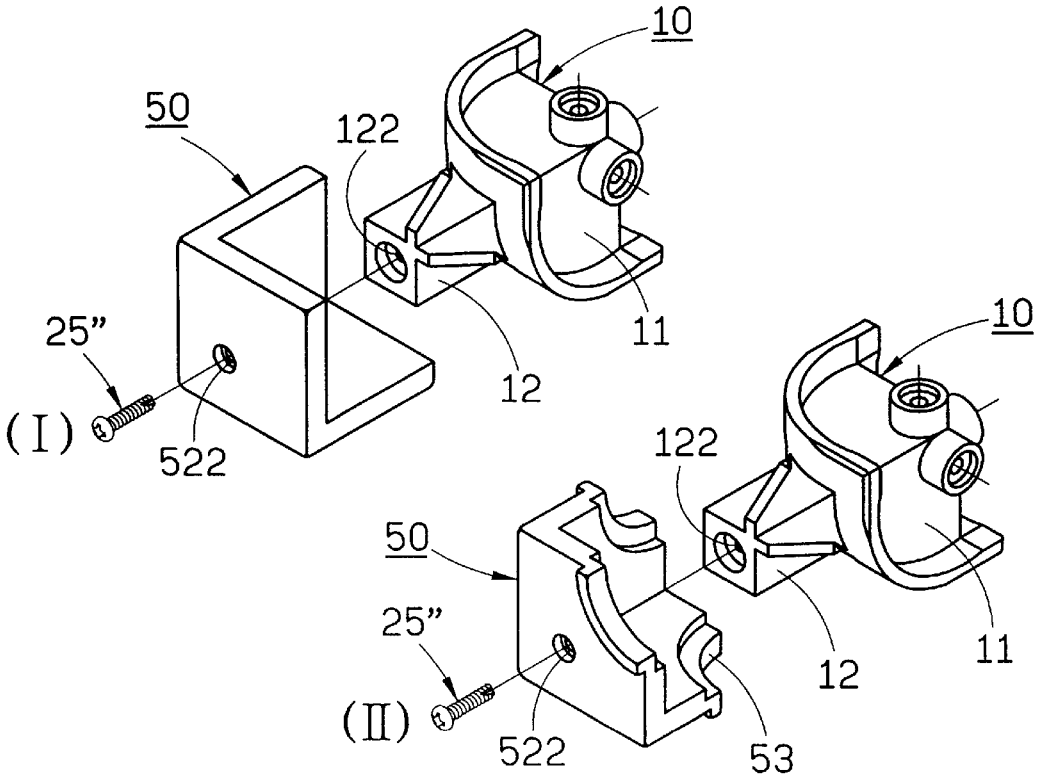
FIG. 23 is a perspective view of some reference smaller blocks and outer housing blocks of the present invention in assembling.

Please refer to FIG. 23 which shows a schematic view showing a reference smaller block 10 and an outer housing block 50 of the type respectively as shown in FIGS. 21 and 22 of the present invention in assembling, wherein, mode of assembling of the outer housing blocks 50 is same no matter there are quarter-round guide rails 53 or not, that is, after the stubs 522 are inserted in the countersunk screw holes 122, by screwing tight of the screws 25", assembling of the reference smaller block 10 with the outer housing blocks 50 is completed.

Figure 24:
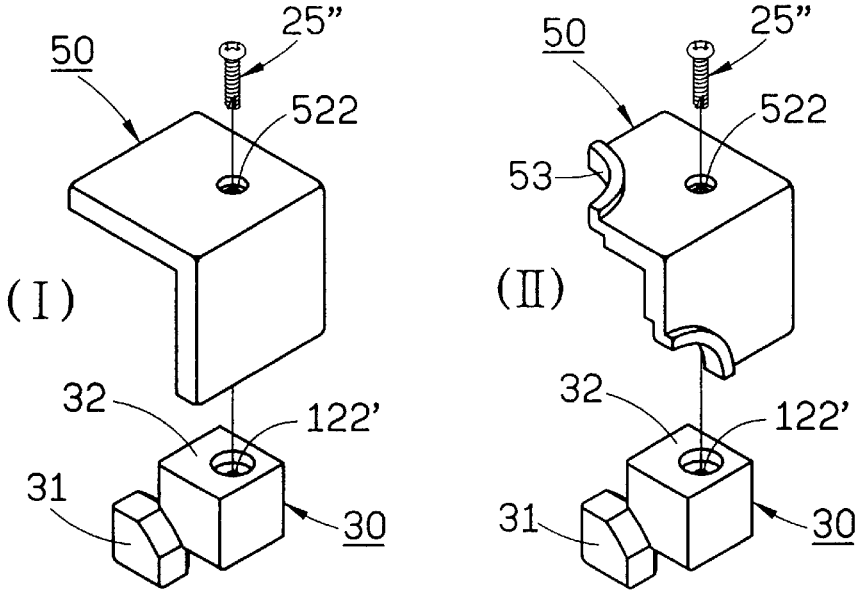
FIG. 24 is a schematical view of some outer slidable blocks and outer housing blocks of the present invention in assembling.

FIG. 24 is a schematical view of some outer slidable blocks 30 and outer housing blocks 50 of the present invention in assembling. Wherein, mode of assembling of the outer housing blocks 50 is same no matter there are quarter-round guide rails 53 or not, that is, after the stubs 522 are inserted in the countersunk screw holes 122', by screwing tight of the screws 25", assembling of the outer slidable blocks 30 with the outer housing blocks 50 is completed.

Figure 25:
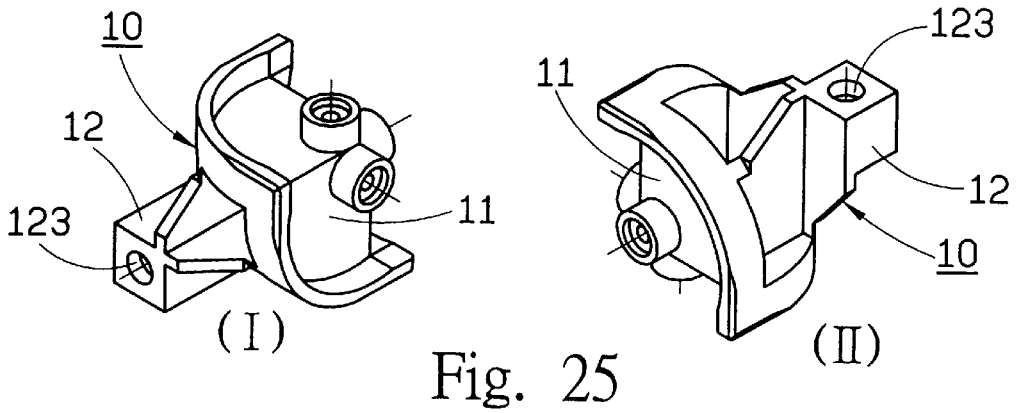

Referring to FIGS. 25 to 29 which are views showing the second assembling mode of the present invention, wherein:

FIG. 25 shows a front and a rear perspective view respectively of a reference smaller block 10, the shape thereof is the same as that in the above stated assembling mode, however, a plain hole 123 takes the place of the countersunk screw hole 122.

Figure 26:
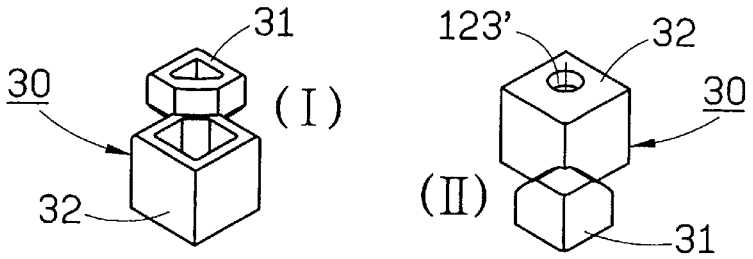

FIG. 26 shows a front and a rear perspective view respectively of an outer slidable block 30, the shape thereof is the same as that in the above stated assembling mode, however, a plain hole 123' again takes the place of the countersunk screw hole 122'.

Figure 27:
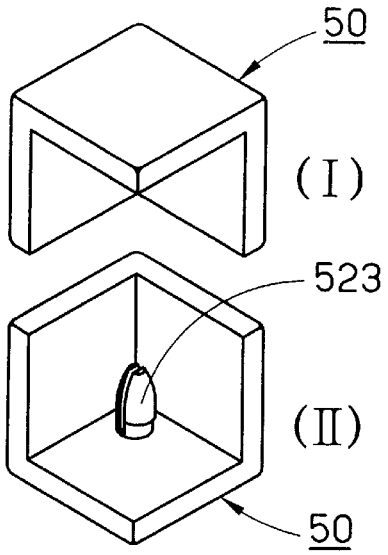

FIG. 27 shows a front and a rear perspective view respectively of an outer housing block 50, the bottom thereof is provided with an engaging post 523 having a diameter slightly larger than that of the holes 123 (123'), and being hollow and flexible.

Figure 28:
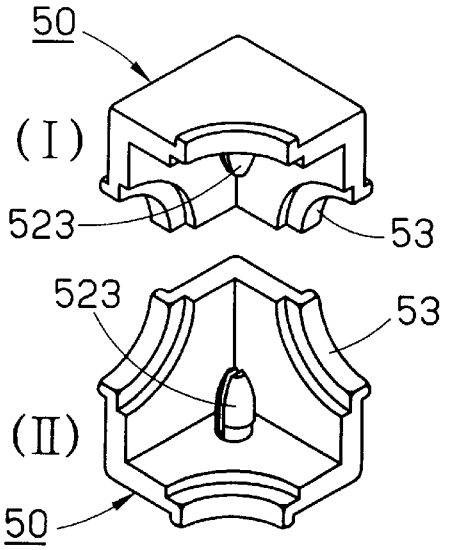

FIG. 28 shows a front and a rear perspective view respectively of an outer housing block 50 having quater-round guide rails 53, the bottom thereof is also provided with an engaging post 523 as stated above.

Figure 29:
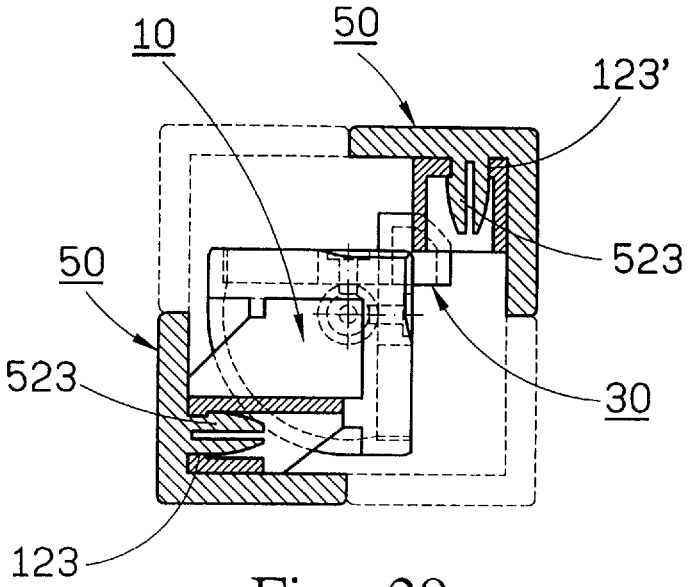

As shown in FIG. 29, in assembling, when the engaging post 523 of an outer housing block 50, the holes (123, 123') of a reference smaller block 10 and an outer slidable block 30 are aligned, assembling thereof can be completed just by pressing.

Figure 30:
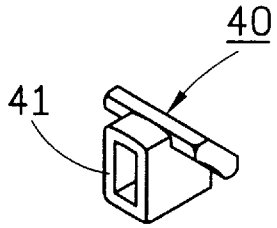
FIG. 30 is a drawing showing another embodiment of inner slidable block of the present invention jection molded with plastic.

The names and the shapes of the members given in the above statement and drawings are only for convenience of description of the present invention rather than for limitation the scope of patent right thereof, for example, as shown in FIG. 11, shape of an inner slidable block 40 can also be in the shape as shown in FIG. 30, i.e., the bottoms of the access plates of the inner slidable blocks are also excavated, for the sake of reducing weight. Therefore, various changes may be made for the detailed construction, it is understood that such changes will be within the spirit and scope of the present invention.

I claim:

1. A two-layer intellectual cube comprised apparently of eight smaller movable blocks and having six sides facing to different orientations, each of said sides being divided vertically and horizontally into four smaller movable surfaces, by changeability of orientation by rotation of said smaller movable blocks, each of said sides having various possibilities of combination of said smaller movable surfaces, said cube is characterized in that:

when in assembling, the interior portion of one of said eight smaller movable blocks is taken as a reference smaller block which has a triangular axle seat extending from an inner end thereof, said triangular axle seat is provided on the corner formed by three surfaces thereof with three mandrels which are perpendicular to one another and are located toward three different orientations, taking each of said mandrels as a center, an arciform raised rail is provided on the wider area of every one of said three surfaces of said triangular axle seat, said mandrels are pivotally provided each with a rotatable block, a receiving space is formed between every said rotatable block and the corresponding one of said raised rails to separate a plurality of outer and inner slidable blocks, so that said outer and inner slidable blocks can be displaced revolvingly about a corresponding one of said mandrels along a track of said corresponding raised rail, in which, each said outer slidable block is provided on an outer end thereof with a seat block, and when an outer housing block is provided on each of said eight smaller movable blocks, said two-layer intellectual square cube is completed.

2. A two-layer intellectual cube as in claim 1, wherein, said outer housing blocks amount to eight of which each is provided with three smaller movable blocks in different orientations respectively, said smaller movable surfaces each has a rotatable plate provided on an inner corner thereof, after assembling, each side of said intellectual cube have four rotatable plates provided at the center thereof, said eight smaller movable blocks can be displaced revolvingly to change their orientations, so that said smaller movable surfaces in said side have a variety of combination, while said rotatable plates can rotate at the central position of said side to change relative positions thereof with said smaller movable surfaces, thus variety of combination of each said side is increased.

3. A two-layer intellectual cube as in claim 1 or 2, wherein, three smaller movable surfaces directing to different orientations of each said outer housing block are provided respectively on-one end corner of each of them with a quater-round guide rail; after assembling of said outer housing blocks, at the center position of each side, said quater-round guide rails on four of said smaller movable surfaces in said side are connected to form a round, and a plurality of rotatable plates are slidably provided each on one of said quater-round guide rails, hence when a side is neatly flat, a round composed of said quater-round guide-rails allows said rotatable plates to displace by rotation and sliding at said center and to slide from one of said smaller movable surfaces to another.

4. A two-layer intellectual cube as in claim 1, wherein, an inner end of said reference smaller block extends to form said triangular axle seat, while the other end of said reference smaller block opposite to said triangular axle seat is formed a seat block; said arciform raised rails take said mandrels of said triangular axle seat as their centers respectively;

the shape of a projection of each said rotatable block is a "T", a pivot joint on one end thereof is pivotally connected to one of said mandrels of said triangular axle seat, while three limiting plates are provided each on the other ends thereof and form a receiving space with said arciform raised rails provided on said triangular axle seat as well as with the others of said limiting plates, the outer areas are broader than the inner areas of said receiving space;

each said outer slidable block includes a slidable portion which is in the shape of a triangular block and is formed with a guide corner on the tip thereof, and a seat block is extended from said slidable portion, in which, an end with a right angle of said slidable portion is inserted inwardly in said receiving spaces, so that said slidable portion is limited but slidable in said receiving space, and is located in the circumference of said mandrels of said triangular axle seat, said seat block of said outer slidable blocks extends outwardly and is opposite to said seat block of said reference smaller block, and is located at one of the eight corners of said two-layer square cube;

each of said inner slidable blocks is comprised of an access plate and a stop plate, wherein, said access plate is inserted to fill in said receiving space between two neighbouring ones of said slidable portions, and therefore can move synchronically with said slidable portions, width of said stop plate is larger than that of said access plate, said stop plate extends outwardly from said access plate and is located on a periphery of said receiving spaces formed between said arciform raised rails and said rotatable blocks and between every two rotatable blocks, the two sides of said stop plate exactly abut against the surfaces of said slidable portions of two of said outer slidable blocks at both sides thereof, so that said slidable portion is limited in said receiving space and is not to drop;

a plurality of said outer housing blocks fixedly and respectively cover said seat blocks of said seven outer slidable blocks and said seat block of said reference smaller block, and are provided each with three smaller movable surfaces in different orientations, so that the members mentioned above are hidden and together form said two-layer square cube.

5. A two-layer intellectual cube as in claim 4, wherein when in assembling, said slidable portions of said seven outer slidable blocks are firstly arranged to surround said three mandrels of said triangular axle seat respectively and abut against the inner walls of said arciform raised rails, thus said seven seat blocks of said outer slidable blocks and said seat block of said reference smaller block are located respectively at the eight corners of said two-layer intellectual square cube; after said outer slidable blocks are settled, said access plates of said inner slidable blocks are placed between every two slidable portions, so that the two ends of each stop plate abut against the surfaces of said slidable portions of said two outer slidable blocks at both sides thereof, then said rotatable blocks are pivotally fixed onto said mandrels, said limiting plates of said rotatable blocks prevent said slidable portions of said outer slidable blocks and said access plates of said inner slidable blocks from dropping; finally, said eight outer housing blocks are fixed on said seven seat blocks of said outer slidable blocks and said seat block of said reference smaller block to complete assembling of said two-layer intellectual square cube.

6. A two-layer intellectual cube as in claim 4, wherein, said mandrels are drilled to be provided with fixing holes, a throughhole is drilled in each said pivot joint centrally through one of said limiting plates of a corresponding one of said "T" shaped rotatable blocks, and a sleeve with a flange on the outer end thereof is inserted in each said throughhole, align the inner end of said sleeve with a fixing hole on the corresponding one of said mandrels, a screw is threaded in said sleeve and is screwed fixedly in said fixing hole, so that said rotatable block is confined on said mandrel but is rotatable about the same.

7. A two-layer intellectual cube as in claim 4, wherein, said seat blocks of said outer slidable blocks and said seat block of said reference smaller block are provided each with a connecting hole, correspondingly, said outer housing blocks are provided each with a bore, when in assembling, a plurality of screws are used to extend each through one of said bores to be fixedly connected onto one of said connecting holes, and finally a plurality of lids are used to cover said screws, said two-layer intellectual square cube thus is completed in the form of a square cube.

8. A two-layer intellectual cube as in claim 4, wherein, said seat blocks of said outer slidable blocks and said seat block of said reference smaller block are provided each with a countersunk screw hole, the inner side of one end plate of each of said outer housing blocks is provided with a stub corresponding in position to said countersunk screw hole; when in assembling, after said stubs are inserted in said countersunk screw holes, by screwing tight of screws, assembling of said seat blocks with said outer housing blocks is completed.

9. A two-layer intellectual cube as in claim 4, wherein, said seat blocks of said outer slidable blocks and said seat block of said reference smaller block are provided each with a plain hole, said outer housing blocks each is provided with an engaging post having a diameter slightly larger than that of said plain holes and being hollow and flexible, in assembling, when said engaging post of said outer housing block and said holes of said reference smaller block are aligned, assembling thereof can be completed just by pressing.

10. A two-layer intellectual cube as in claim 4, wherein, said seat block of said reference smaller block is reduced in size and is in the shape of a small square cube, and is provided thereon with reinforcement ribs, the bottoms of said slidable portions and said seat blocks of said outer slidable blocks are excavated, and the bottoms of said access plates of said inner slidable blocks are also excavated, for the sake of reducing weight.

11. A two-layer intellectual cube comprised apparently of eight smaller movable blocks and having six sides facing to different orientations, each of said sides being divided vertically and horizontally into four smaller movable surfaces, said four smaller movable surfaces on each side of said intellectual cube have four rotatable plates provided at the center thereof; by changeability of orientation by rotation of said smaller movable blocks, each of said sides having various possibilities of combination of said smaller movable surfaces, said rotatable plates can rotate at the central position of said side to change relative positions thereof with said smaller movable surfaces, thus variety of combination of each said side is increased.

12. A two-layer intellectual cube as in claim 11, wherein, the surfaces of said eight smaller movable blocks are covered by a plurality of outer housing blocks having each three smaller movable surfaces directing to different orientations, and are provided respectively on one end corner of each of them with a quarter-round guide rail, said quarter-round guide rails on said smaller movable surfaces are connected to form a round at the center position of each of said sides, said rotatable plates are slidably provided each on one surface of a quarter-round guide rail, hence when in assembling and when a side is neatly flat, said rotatable plates can be displaced by rotation and sliding at the center and to slide from one of the smaller movable surfaces to another.

* * * * *